US005250994A

United States Patent [19]

Ito et al.

[11] Patent Number: 5,250,994

[45] Date of Patent: Oct. 5, 1993

[54] IMAGE FORMING APPARATUS HAVING TRANSFER MEMBER SUPPORTING MEMBER

[75] Inventors: Akira Ito, Tokyo; Mitsugu Inomata, Kawasaki; Yasuo Ito, Yokosuka; Hisayoshi Kojima, Yokohama; Tatsuya Kobayashi; Toshiaki Miyashiro, both of Tokyo, all of Japan

[73] Assignee: Canon Kabushiki Kaisha, Tokyo, Japan

[21] Appl. No.: 965,708

[22] Filed: Oct. 23, 1992

[30] Foreign Application Priority Data

Oct. 30, 1991 [JP] Japan ..... 3-311795
Oct. 30, 1991 [JP] Japan ..... 3-311797

[51] Int. Cl.[5] ..... G03G 15/14
[52] U.S. Cl. ..... 355/271; 355/274
[58] Field of Search ..... 355/278, 277, 271, 274, 355/276; 430/126

[56] References Cited

U.S. PATENT DOCUMENTS

| | | | |
|---|---|---|---|
| 3,924,943 | 12/1975 | Fletcher . | |
| 4,309,803 | 1/1982 | Blaszak . | |
| 4,674,860 | 6/1987 | Tokunaga et al. . | |
| 4,862,224 | 8/1989 | Ku | 355/271 X |
| 5,038,178 | 8/1991 | Hosoya et al. | 355/277 |
| 5,140,376 | 8/1992 | Gotoda | 355/274 |
| 5,168,313 | 12/1992 | Hosaka et al. | 355/274 |

*Primary Examiner*—R. L. Moses
*Attorney, Agent, or Firm*—Fitzpatrick, Cella, Harper & Scinto

[57] ABSTRACT

An image forming apparatus capable of performing a suitable transport that is free from the occurrence of an inner blank, and is free from image or color misalignment. A transfer member supporting member, for supporting a transfer member at a transfer position at which the toner image on the image carrier is transferred to the transfer member, has a dielectric layer defining its outer surface and an elastic layer provided inside the dielectric layer. The elastic layer preferably has a compression range between about 0 to 2 mm at the transfer position, and the total pressure of this compression is about 1 kg/mm in this compression range.

13 Claims, 7 Drawing Sheets

IMAGE FORMING APPARATUS HAVING TRANSFER MEMBER SUPPORTING MEMBER

BACKGROUND OF THE INVENTION

1. Field of the Invention

This invention relates to an apparatus for forming an image by an electrophotographic or electrostatic recording process in which a developed image (toner image) obtained by being developed on an image carrier by a developer is transferred to a transfer member supported on a transfer member supporting member. More particularly, the present invention can suitably be realized as a color copying machine or a color laser beam printer which forms a multicolor image by repeating transfer of developed images to a transfer member on a transfer member supporting member a number of times in correspondence with the number of color components.

2. Description of the Related Art

Conventionally, a transfer drum 105, such as that shown in FIG. 7, is used, for example, as a transfer device for use in a color electrophotographic copying machine. This transfer drum 105 has parallel flanges 101 and 102 and a connection member 103 which connects the flanges 101 and 102. An opening 104 is defined in the circumferential surface of the transfer drum 105. A transfer member supporting member 106 having a layer of dielectric material such as polyvinylidene fluoride (PVDF) is wrapped around the transfer drum 105 over the opening 104. A corona discharge device 107 is disposed inside the transfer drum 105 to perform a transfer operation by causing corona discharge from the reverse side of the transfer member supporting member 106.

A toothed portion 108 is formed on the flange 102 of the transfer drum 105, as shown in FIG. 7. The toothed portion 108 meshes with a gear (not shown) formed on one of two flanges of an image carrier in the form of, for example, a drum, i.e., a photosensitive drum, to be driven and rotated by this gear.

Hard rubber layers (not shown) are formed to extend outwardly on the outer circumferential surfaces of the flanges. The rubber layers contact the outer circumferential surfaces of the flanges of the photosensitive drum to set the transfer drum and the image carrier in positions in a predetermined relationship. The thickness of a rubber layer is selected so that a gap corresponding to the thickness of a transfer member is formed between the transfer member supporting member and the photosensitive drum.

A pressing member (not shown) is further provided to press the reverse surface of the transfer member supporting member 106 with a small pressure during transfer, so that the transfer member and the photosensitive drum contact at a uniform pressure.

In the thus-constructed transfer drum, however, the area available for supporting the transfer member supporting member 106 at the circumferential surface of the transfer drum 105 is very small and a problem concerning durability of the transfer member supporting member 106 is therefore encountered.

On the other hand, a roller transfer device is known in which a transfer member supporting member 106 comprises a transfer drum having a foamed elastic layer having an outer circumferential surface upon which a dielectric layer is laminated.

In such a known roller transfer device, a suitable pressure for contact between the transfer member and the photosensitive drum is set by a deforming of the elastic foam layer of the transfer drum. Then, the transfer drum having the elastic foam layer is pressed against the photosensitive drum at a constant pressure. A transfer device having a transfer drum having such an elastic foam layer is advantageous because the entire dielectric layer is supported on the elastic foam layer from the reverse side, and the durability of the dielectric layer is higher in comparison with the transfer drum shown in FIG. 7.

Moreover, the roller transfer device requires no corona discharge device and therefore avoids the generation of ozone. These advantages of the roller transfer device have attracted attention.

However, the roller transfer device having the above-described construction also entails drawbacks described below.

That is, if the contact pressure between the image carrier in the form of a photosensitive drum or the like and the transfer drum is excessively large, there is a possibility of a failure to transfer an inner portion of a toner image, i.e., there may be a blank in the transferred image (hereinafter referred to as "inner blank").

Further, if the extent to which the transfer drum is compressed is excessively large, there is a possibility that Q the actual transferred image will be shifted from the position at which the image transferred to the transfer member thereafter is meant to be formed. Such a phenomenon results in a color misalignment in the case of a color image forming apparatus.

SUMMARY OF THE INVENTION

An object of the present invention is to provide an image forming apparatus capable of performing a suitable transfer that is free from the occurrence of an inner blank.

Another object of the present invention is to provide an image forming apparatus in which the contact pressure between the image carrier and the transfer member supporting member is constant.

Still another object of the present invention is to provide an image forming apparatus capable of creating a high-quality image that is free from image misalignment or color misalignment.

To achieve these objects, according to the present invention, there is provided an image forming apparatus comprising an image carrier, image forming means for forming a toner image on the image carrier, and a transfer member supporting member for supporting a transfer member at a transfer position at which the toner image on the image carrier is transferred to the transfer member. The transfer member supporting member has a dielectric layer defining its outer surface and an elastic layer provided inside the dielectric layer. The elastic layer is compressed between about 0 to 2 mm at the transfer position, and the total pressure of this compression is 1 kg/mm in the compression range of 0 to 2 mm.

Other objects and features of the present invention will become apparent from the following description in conjunction with the accompanying drawings.

BRIEF DESCRIPTION OF THE DRAWINGS

FIG. 1-A is an expanded cross-sectional view of the surface-forming materials of the transfer device, shown as the region marked "I" in FIG. 1.

DESCRIPTION OF THE PREFERRED EMBODIMENTS

Figure 2:
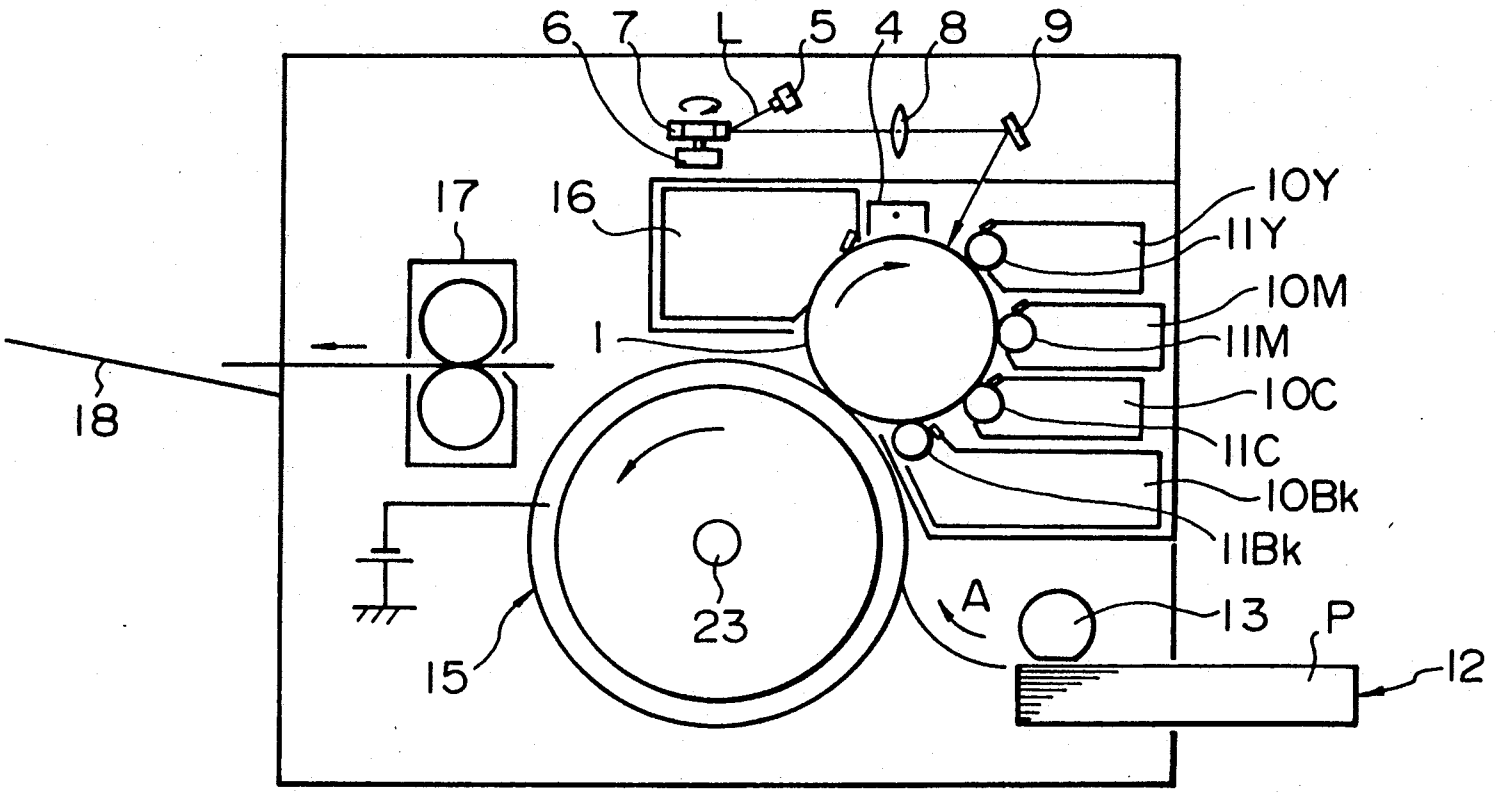
FIG. 2 is a cross-sectional view of a color image forming apparatus in accordance with an embodiment of the present invention.

An image forming apparatus in accordance with the present invention will be described below in detail with reference to the accompanying drawings. FIG. 2 shows an embodiment of the image forming apparatus of the present invention realized as a color image forming apparatus such as an electrophotographic-type color laser beam printer.

As shown in FIG. 2, the color laser beam printer has a photosensitive drum 1 which is an image carrier capable of rotating in the direction of the arrow and which typically has a diameter of 60 mm. A primary charger 4, and components of exposure means, i.e., a semiconductor laser 5, a scanner motor 6, a polygon mirror 7 rotated by the scanner motor 6, a lens 8 and and a mirror 9, are disposed around the photosensitive drum 1. The exposure means operates in such a manner that light L emitted from the semiconductor laser 5 supplied with a video signal from a controller is reflected by the polygon mirror 7 for scanning and then is directed to the photosensitive drum 1 via the lens 8 and the mirror 9 to form a latent image on the photosensitive drum 1.

Development devices for forming toner images from the latent image on the photosensitive drum are also disposed around the photosensitive drum 1. That is, there are provided a development device 10Y containing a yellow toner and having a development sleeve 11Y, a development device 10M containing a magenta toner and having a development sleeve 11M, a development device 10C containing a cyan toner and having a development sleeve 11C, a development device 10Bk containing a black toner and having a development sleeve 11Bk.

Transfer members P, which are ordinarily sheets of transfer paper, are stored in a paper feed cassette 12, and are transported one by one in the direction of the arrow A to a transfer device 15, the construction of which will be described later in detail.

As transfer paper P retained on the transfer device 15 passes a transfer position at which it faces the photosensitive drum 1, a toner image on the photosensitive drum is electrostatically transferred to the transfer paper P. If images in a plurality of colors are to be transferred to one transfer paper sheet by being superposed, a toner image is formed on the photosensitive drum one color at a time and is transferred to transfer paper retained on the transfer device. The transfer operation is repeated however many times is needed to achieve the desired multi-colored image.

Residual toner remaining on the photosensitive drum 1 after each transfer to transfer paper P transported by the transfer device 15 is removed by a cleaner 16. On the other hand, the toner images on the transfer paper P separated from the transfer device 15 are fused and fixed by a thermal fixing device 17, and the transfer paper P is thereafter discharged onto a discharge tray 18. In this embodiment, the photosensitive drum 1, the charger 4, the development devices 10Y to 10Bk and the cleaner 16 are combined into one cartridge which is detachably attached to the apparatus body.

An example of the transfer device 15 in accordance with the present invention will now be described below with reference to FIGS. 1 and 1-A. The transfer device 15 shown comprises a transfer drum which typically has a diameter of 120 mm and comprises a hollow aluminum drum 20 and flanges 21 and 22 that are disposed at opposite ends of the drum 20. The flanges 21 and 22 are formed of an insulating material. The transfer drum also has a transfer member supporting member provided on the outer circumferential surface of the hollow drum 20. A fixed shaft 23 passes through the transfer drum at an axial central position thereof. The transfer drum is rotatably supported on the fixed shaft 23 by bearings 24 provided on the two flanges 21, 22. A toothed portion 25 is formed on the flange 21. The toothed portion 25 meshes with a flange gear (not shown) of the photosensitive drum 1 as shown in FIG. 2, and this gear receives a driving force from a drive source in order to drive and rotate the transfer drum. A gripper for holding transfer paper also can be provided on the transfer drum.

Figures 1, 1A:
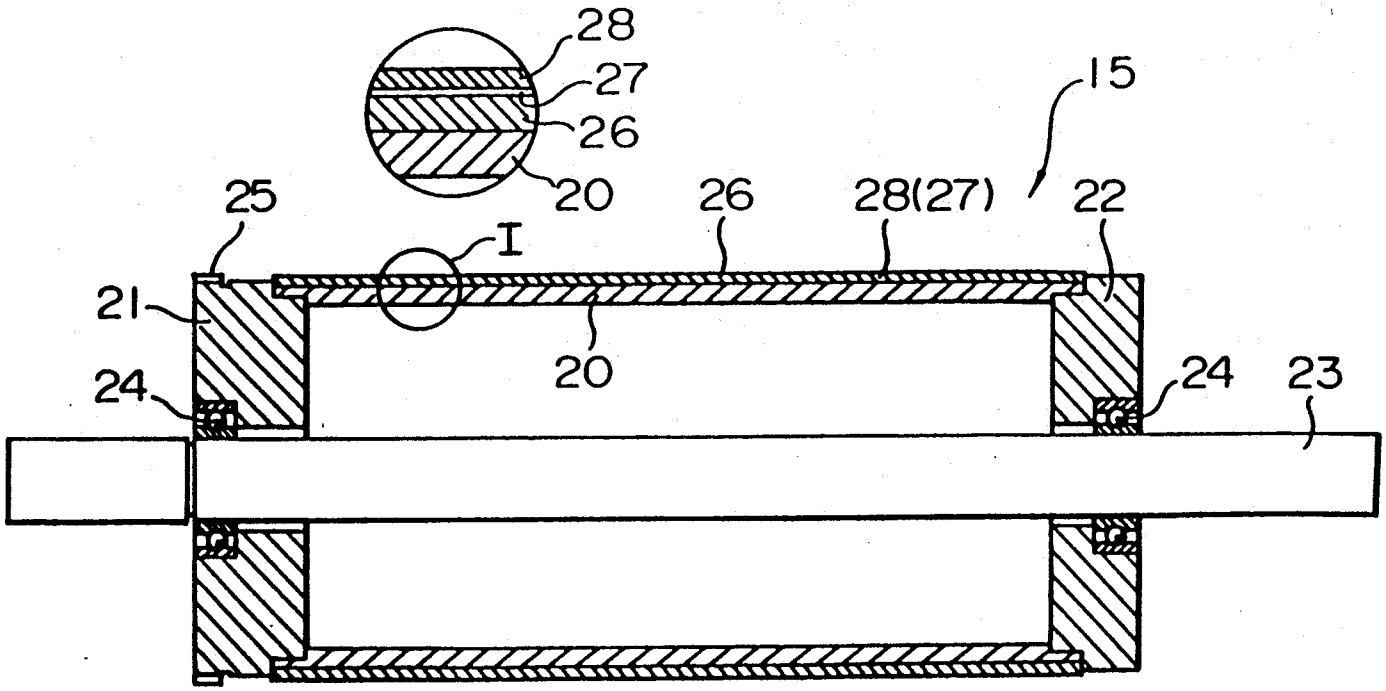
FIG. 1 is a cross-sectional view of an example of a transfer device constructed in accordance with the present invention.

In accordance with the present invention, the transfer member supporting member is formed by laminating an elastic foam layer 26, an electroconductive layer 27 and a dielectric layer 28 with an adhesive on the outer circumferential surface of the hollow drum 20 as shown in FIG. 1-A. The hollow drum 20 and the electroconductive layer 27 are electrically connected. Preferably, the dielectric layer 28 is formed of a sheet of polyvinylidene fluoride, polyethylene terephthalate, or ethylene-propylene fluoride copolymer, and the electroconductive layer 27 is formed by aluminum deposition on this dielectric sheet. It is desirable to set the volume resistivity of the dielectric layer to $10^{12}$ Ω/cm or greater for the purpose of suitably attracting the transfer sheet to the transfer drum by an electrostatic force. The electroconductive layer serves as an electrode to which a transfer voltage is applied. It is desirable to set the volume resistivity of the electroconductive layer to $10^5$/Ωcm or smaller. The elastic foam layer 26 is, preferably, formed of a soft urethane foam. A suitable range for the thickness of the elastic foam layer 26 is between about 2 to 10 mm, and a range of 3 to 5 mm is preferable. It is preferable to have a foam layer thickness of at least 3 mm to ensure the desired elasticity of the soft urethane foam. Further, if the thickness of the urethane foam is greater than 5 mm, when forming an elastic foam layer 26 by wrapping urethane foam around the transfer drum and fixing the urethane foam by bonding, the deformation of the urethane foam is large and considerable. Therefore, when the thick foam is wrapped around the transfer drum, creases or the like can occur easily at the time of bonding, and workability is reduced. It is desirable that the density of this soft urethane foam is between about 20 to 150 kg/m$^3$.

Figure 3:
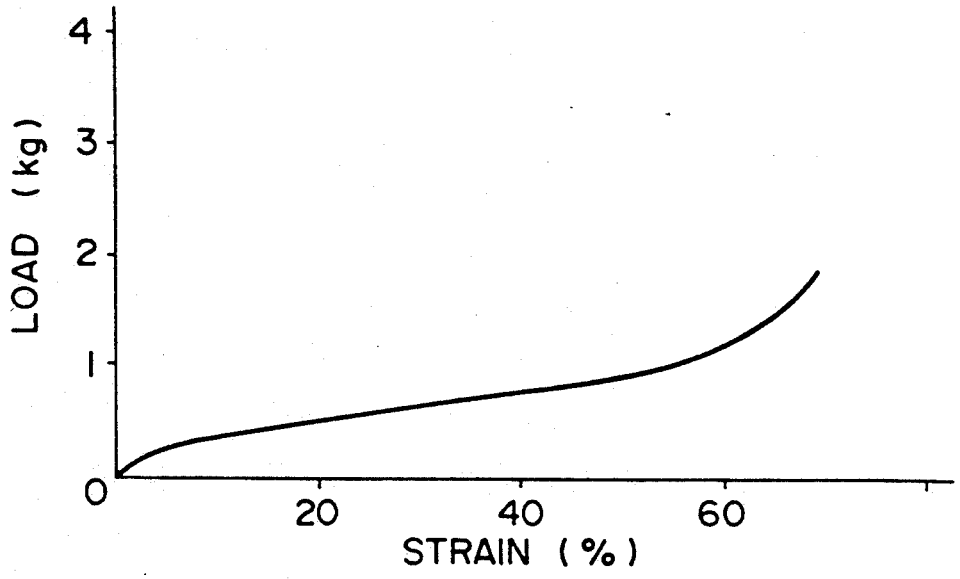
FIG. 3 is a diagram of a load characteristic for a soft urethane foam material.

Generally, soft urethane foams exhibit a characteristic such that, as shown in FIG. 3, the load to cause a certain deformation rises at a substantially high rate in an initial deformation range. The load then begins to change gradually with respect to the deformation at a certain point and, finally, increases at a high rate. In accordance with the present invention the urethane foam preferably is in the range of a gradual load change, in which the load characteristic with respect to a compression is substantially flat. This range is utilized to achieve a suitable toner image transfer that is free from any inner blank, within a wide range of deformation to the transfer member supporting member, i.e., to the elastic foam layer 26.

Figure 4:
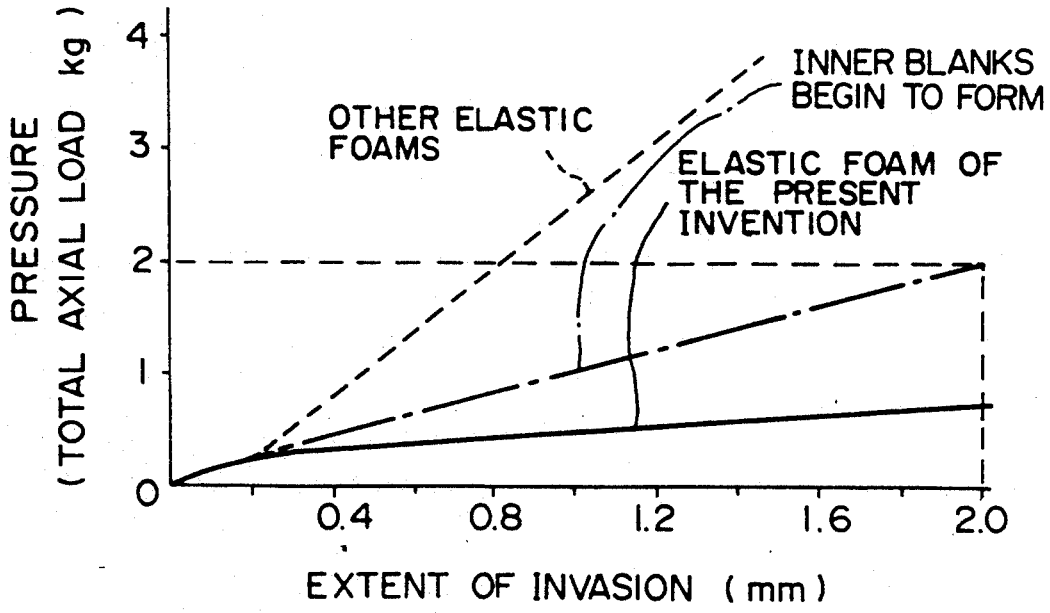
FIG. 4 is a diagram of a load characteristic for an elastic foam layer in accordance with the present invention.

In FIG. 4, the load characteristic of the soft urethane foam forming the elastic foam layer 26 in this embodiment is indicated by the solid line. Specifically, a transfer free from color misalignment has been achieved in the total load range of 300 to 800 g, and a wide range of allowable deformation to the elastic foam layer 26 in the radial direction caused by the contact between the transfer drum 15 and the photosensitive drum 1, in the range of about 0 to 2.0 mm, has been achieved. Further, as a result of experimentation, it has been found that the occurrence of inner blanks can be prevented if the load is not greater than 1 kg/mm (as indicated by the dot-dash line in FIG. 4) wherein the extent of deformation also is within the range of 0 to 2.0 mm. The extent of deformation of the elastic layer was measured when no transfer sheet was present at the transfer position. When the extent of deformation was greater than 2.0 mm, an actual transferred image was shifted from the normal position at which the image should be transferred to a transfer sheet, resulting n color misalignment. This color misalignment occurred in a direction substantially perpendicular to the direction of rotation of the transfer drum. The thickness of transfer sheets available in this apparatus is in the range of about 0.1 to 0.15 mm. A silicon sponge having the same load characteristic as the above-described soft urethane foam also may be used to form the elastic layer in accordance with this embodiment.

However, if a foam material such as a hard urethane foam (having a density greater than 150 kg/m$^3$) is used as the elastic layer, the rate at which the load is increased with respect to the extent of deformation is so large that the range of deformation becomes very small with respect to a load range not greater than 1 kg/mm, with the result that an inner blank can occur easily.

Thus, the use of the elastic foam layer 26 formed of a soft urethane foam or a similar material ensures that a high quality image free from occurrence of inner blanks can be obtained in the above-described large allowable range (shown in FIG. 4). This advantage exists even if the accuracy of the outside diameter of the transfer drum and the accuracy of eccentricity thereof are not precisely set while the distance between the axes of the transfer drum 15 and the photosensitive drum 1 is constantly maintained.

Figure 5:
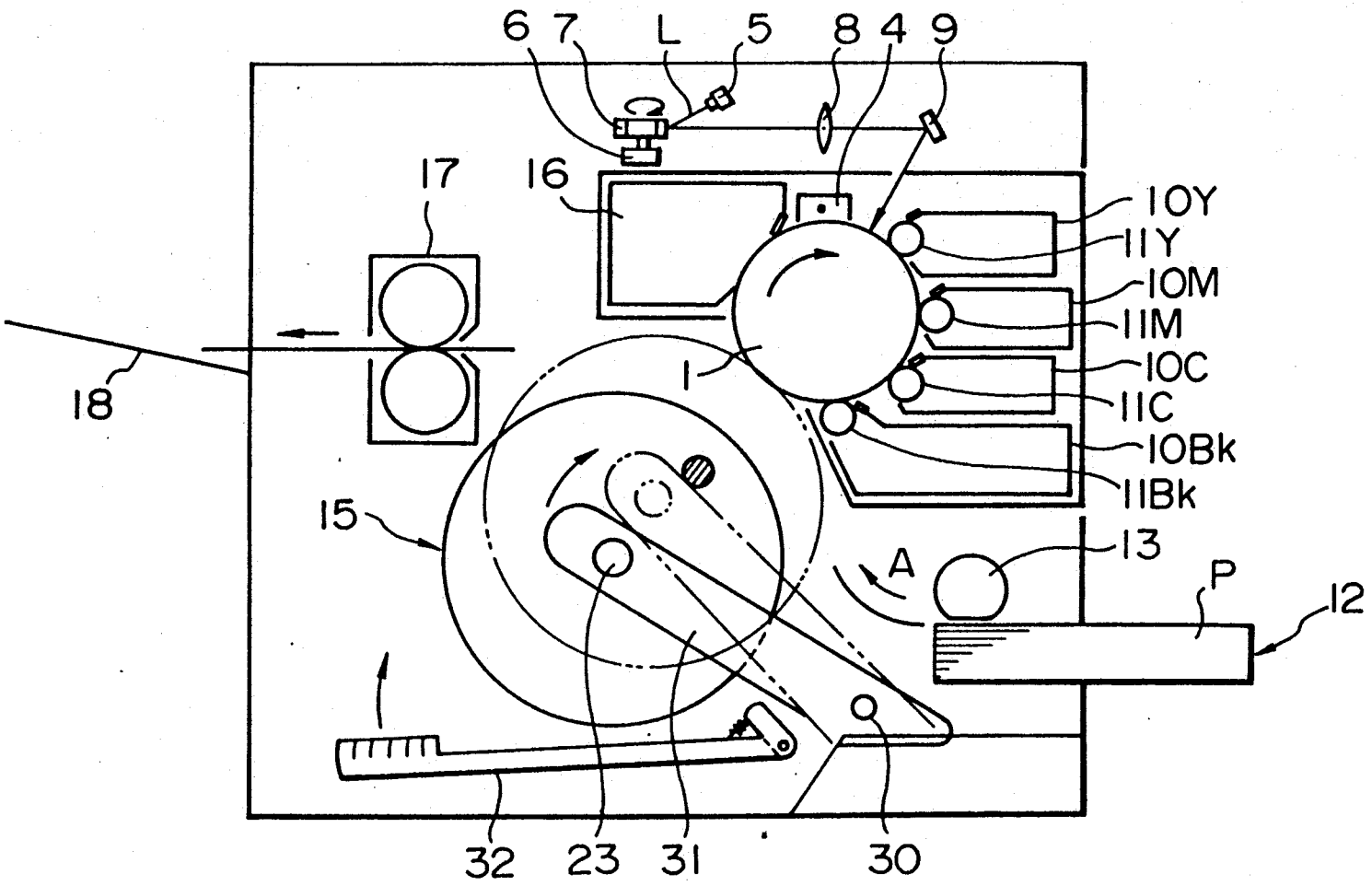
FIG. 5 is a cross-sectional view of a color image forming apparatus in accordance with another embodiment of the present invention.
Figure 6:
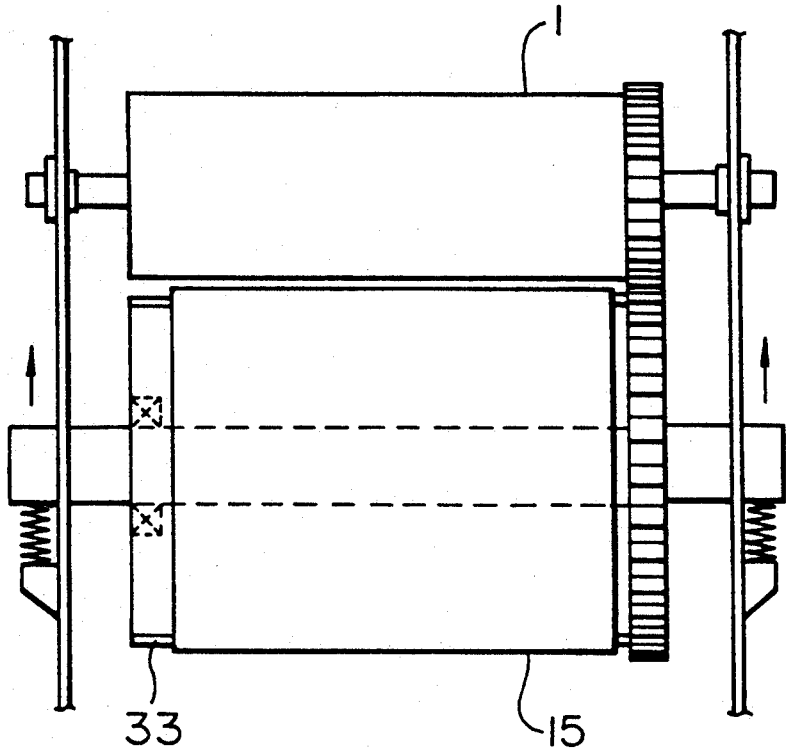
FIG. 6 is a front view of a transfer drum and a photosensitive drum of an image forming apparatus in accordance with a further embodiment of the present invention.

FIGS. 5 and 6 show other embodiments of the present invention.

In the FIG. 5 embodiment, the distance between the transfer drum 15 and the photosensitive drum 1 is maintained constant, and the extent of contact deformation of the transfer member supporting member on the transfer drum 15 is 0.1 mm or greater. In accordance with the embodiments described below, the allowable extent of deformation of the transfer member supporting member may be increased, whereby the apparatus may be arranged so that the transfer drum 15 is brought into contact with, and moved away from, the photosensitive drum 1 in order to facilitate paper jam removal.

In the embodiment shown in FIG. 5, the transfer drum 15 is brought into contact with, and also moved away from, the photosensitive drum 1, as described below. The transfer drum 15 is supported on an arm 31 that is capable of swinging on a shaft 30, whereby the transfer drum 15 is moved close to, or away from, the photosensitive drum 1 by rotating an operating lever 32 that is linked to a swinging arm 31.

Figure 7:
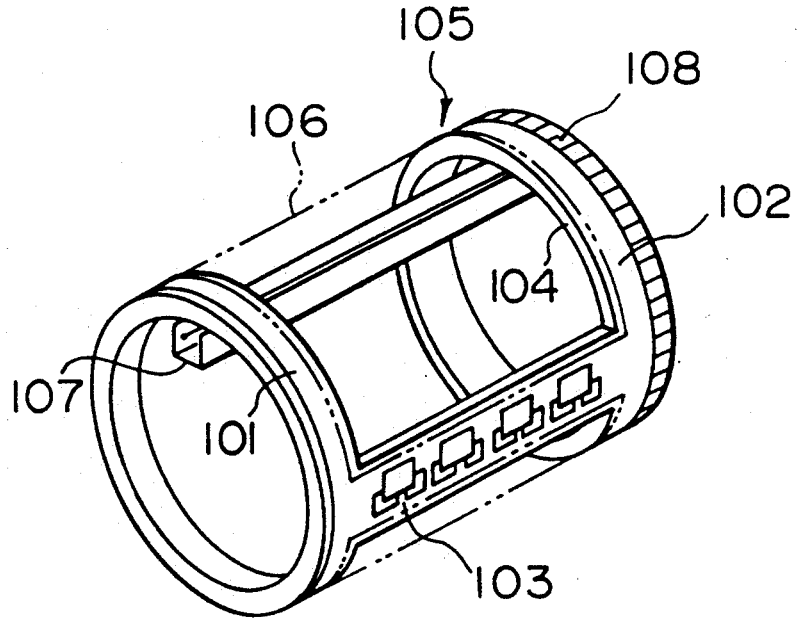
FIG. 7 is a perspective view of the conventional transfer drum.

In the embodiment shown in FIG. 6, a hard rubber layer abutment portion 33 similar to that provided on a conventional transfer drum, as described above with reference to FIG. 7, is attached to each of flanges 21 and 22 of the transfer drum while being recessed from the transfer drum surface. In this embodiment, the transfer drum 15 is urged towards the photosensitive drum 1 by a strong spring 34, or the like, so that the rubber layer abutment portions 33 abuts against the flanges of the photosensitive drum 1.

Thus, if the support shaft of the transfer device is pressed by a spring so as to maintain a constant contact pressure, pressure contact differences between the driving side and the non-driving side of the transfer device can be prevented by providing abutment portions 33 on the transfer drum.

Other known components, as described below, also may be provided, although they are not illustrated in FIG. 2. Around the transfer drum may be disposed a separator/charge remover for separating a transfer sheet, to which a toner image has been transferred, from the transfer drum; a separator claw as an auxiliary separation means for introducing a separated transfer sheet into a transfer member transport path through which the transfer sheet is transported to the fixing device 17; a transfer drum cleaner for removing any toner attached to the transfer drum surface after a separation of the transfer sheet; and a charge remover for removing the transfer voltage which is applied to the transfer drum to initialize the transfer drum. A conventional power source for supplying a predetermined transfer voltage to the transfer drum is also provided.

A contact for applying the transfer voltage from the power source to the transfer drum will be described below. In a conventional image forming apparatus, a contact connected to a power source and capable of being brought into contact with an end of the rotation shaft of the transfer drum, a side surface of the drum body, or an obverse surface of the drum body so as to apply a transfer voltage is provided on the outside of the transfer drum. It is therefore possible that toner, or the like, scattered in the apparatus b jamming, or the like, may attach to the contact and cause a contact failure. Likewise, a spark can occur easily due to a high voltage and cause a noise which badly influences delicate electronic parts.

In accordance with the present invention, therefore, the contact for supplying the transfer voltage (current) to the transfer drum is provided inside the transfer drum so as to improve the durability and reliability of the contact.

Figure 8:
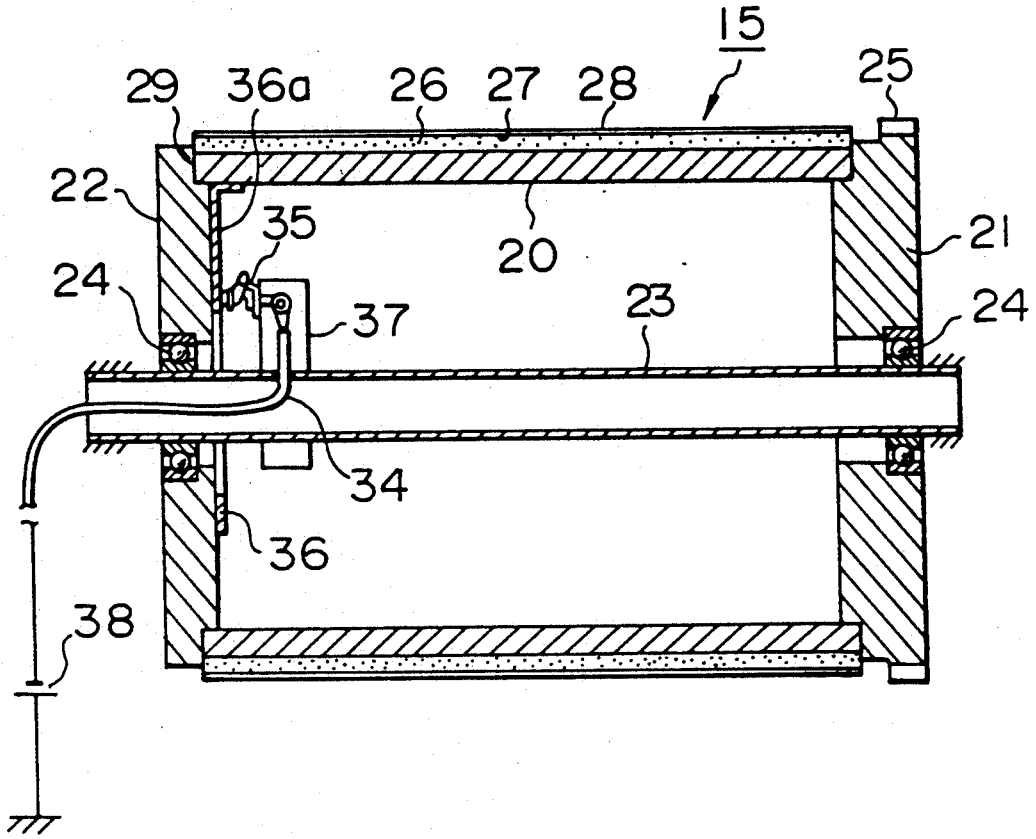
FIG. 8 is a schematic cross-sectional view of a first example of a transfer drum assembly having a contact provided inside thereof.

FIG. 8 shows an example of a transfer drum assembly having such an internal contact. The aluminum-deposited surface of a dielectric layer 28 is electrically connected to a drum 20 by a conductor 29.

Figure 9:
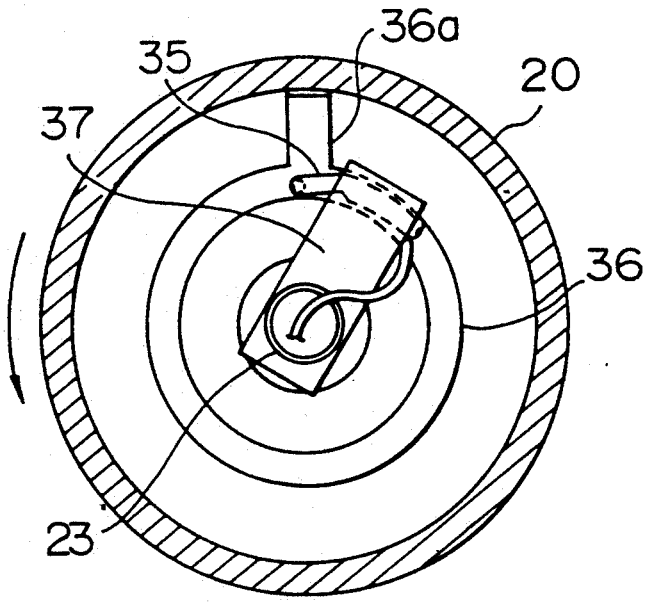
FIG. 9 is a schematic enlarged cross-sectional view of the contact of the transfer drum shown in FIG. 8.

If the transfer drum assembly is arranged to rotate a transfer drum 15 that is on a fixed shaft 23, as in the above-described arrangement, then a slide contact 35 may naturally be used as a contact for applying a high transfer voltage to the transfer drum 15 in the transfer step. In this example, the contact 35 is disposed inside the hollow aluminum drum 20, and a fixed shaft 23 is formed as a pipe, thereby enabling a high-voltage lead wire 34 from the transfer power source 38 to be led through a hole formed in the fixed shaft 23 and to be connected to the contact 35. The contact 35 is fixed on a contact fixation member 37 attached to a portion of the fixed shaft 23 inside the drum 20 and is resiliently pressed so as to electrically contact an annular metallic plate 36 fixed on an internal surface of the first flange 22 and serving as an opposing contact. FIG. 9 is an enlarged diagram of these contact members. The annular metallic plate 36 serving as an opposing contact has a portion 36*a* extending to the internal surface of the aluminum drum 20 and connected to the drum 20. Consequently, the annular metallic plate 36 is electrically connected to the aluminum-deposited inner surface of the dielectric layer 28 trough the aluminum drum 20 and the conductor 29, and the high voltage from the transfer power source 38 is applied to the aluminum drum 20 and the aluminum deposited surface through the contact 35.

In this arrangement, as the transfer drum 15 rotates, the contact 35 slides on the annular metallic plate 36 while electrically contacting the same, so that a transfer voltage from the transfer power source 38 reliably can be applied to the transfer drum 15. Moreover, since the contact 35 and the annular metallic plate 36 serving as an opposed contact are disposed inside the hollow drum 20, no toner, or the like, scattered in the apparatus due to jamming, for example, can attach to the contacts. Therefore, there is no possibility that a contact failure or a high-voltage sparking will occur. The occurrence of noise from the high-voltage lead wire 34 extending from the transfer power source 38 to the contact 35 thereby also is prevented, since the lead wire 34 is located inside the fixed shaft 23.

Figure 10:
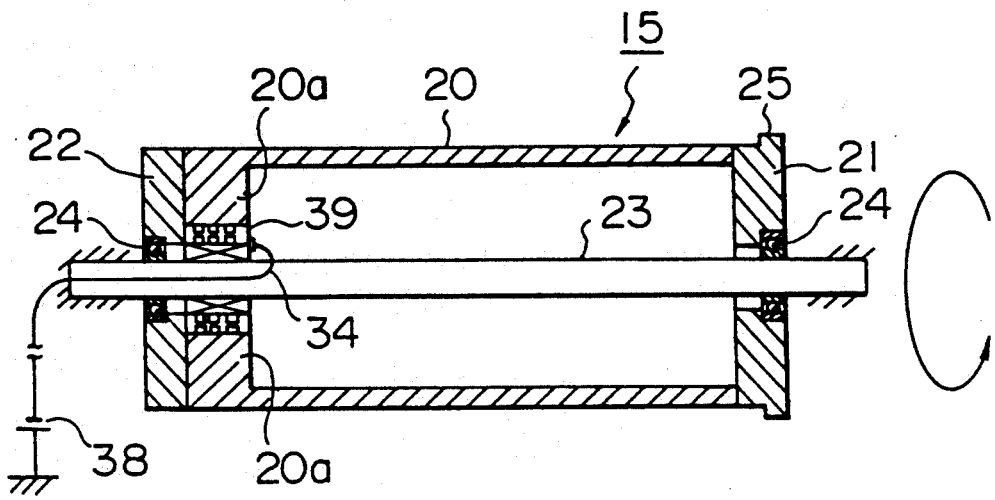
FIG. 10 is a schematic cross-sectional view of an essential portion of a second example of the transfer drum assembly.

FIG. 10 is a schematic cross-sectional view of a second example of a transfer drum assembly having an internal contact. In this example, a high voltage from the transfer power source 38 is applied to a hollow aluminum drum 20 through a slip ring 39. To mount the slip ring 39 between a fixed shaft 23 and the aluminum drum 20, the aluminum drum 20 is not open at one end and has a side wall 20*a* integrally formed with the aluminum drum 20 to close this end, and a circular opening is formed in a central portion of the side wall 20*a*. The slip ring 39 is mounted in this opening. A high-voltage lead wire 34 from the transfer power source 38 is routed through the fixed shaft 23 as in the case of the above-described first example of the transfer drum assembly. Further, the lead wire 34 is led through a hole formed in the fixed shaft 23 and is connected to the slip ring 39. In this example, the aluminum drum 20 is also electrically connected to the aluminum-deposited surface of the dielectric layer (see FIG. 8) through a suitable conductor (not shown).

In this arrangement, the slip ring 39 is electrically connected to the aluminum drum 20, and a high voltage from the transfer power source 38 is applied to the aluminum drum 20 and the aluminum-deposited inner surface of the dielectric film through the high-voltage lead wire 34 and the slip ring 39 with reliability. Moreover, since the slip ring 39 is disposed inside the hollow drum 20, toner, or the like, scattered in the apparatus at the time of jamming or the like, can not attach to contact portions of the slip ring 39, and there is no possibility of a contact failure or a high-voltage sparking. Occurrence of noise from the high-voltage lead wire 34 extending from the transfer power source 38 to the slip ring 39 can also be prevented because the lead wire 34 is routed inside of the fixed shaft 23. Thus, this example of a usable transfer drum assembly has the same advantages as the first example.

Figure 11:
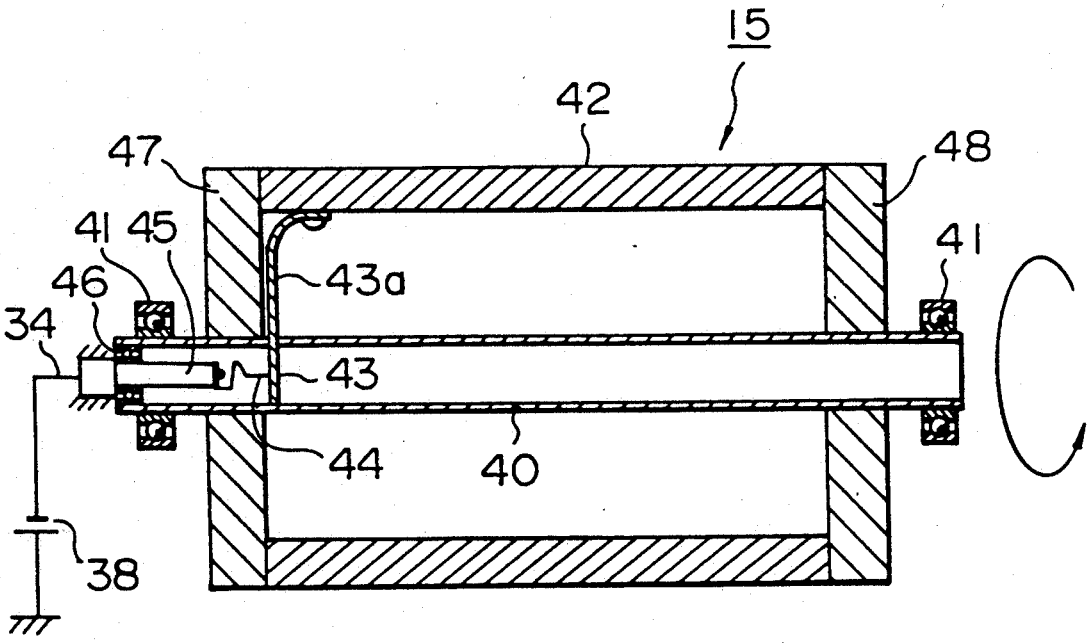
FIG. 11 is a schematic cross-sectional view of an essential portion of a third example of the transfer drum assembly.

In the above-described first and second examples of a transfer drum assembly, the transfer drum 15 is rotated on a fixed shaft 23. However, the present invention can also be applied to an arrangement wherein a rotating shaft is attached to a transfer drum 15 and the transfer drum 15 is rotated by a rotating shaft. FIG. 11 shows a third example of a transfer drum assembly having an internal contact and also arranged in this manner.

In this example, a rotating shaft 40 attached to the transfer drum 15 also has the shape of a pipe, and is rotatably supported by bearings 41. A hollow aluminum drum 42 is electrically connected to the aluminum-deposited surface of the dielectric layer (see FIG. 8) through a suitable conductor (not shown). On the other hand, a bearing 46 is attached to an inner surface portion of one of two opening ends of the rotating shaft 40, and a rod-like contact fixation member 45 is inserted in the bearing 46 and is fixed at its outer end coaxially with the rotating shaft 40. A terminal to which a high-voltage lead wire 34 from the transfer power source 38 is connected is provided on an outer end portion of the contact fixation member 45. A contact 44 is attached to an inner end portion of the contact fixation member 45 so as to resiliently contact a conductor plate serving as an opposing contact member fixed on the rotating shaft 40, i.e., a metallic plate 43 by being pressed against the same. The metallic plate 43 has a portion 43*a* that extends to the inner surface of the aluminum drum 42 and connects to the drum 42. Consequently, the metallic plate 43 is also connected electrically to the aluminum-deposited inner surface of the dielectric layer through the aluminum drum 42 and an unillustrated conductor. The high voltage from the transfer power source 38 is applied to the aluminum drum 42 and the aluminum-deposited surface of the dielectric layer through the contact 44 and the metallic plate 43.

In this example, since the transfer drum 15 is rotated by the rotation of the rotating shaft 40, there is no need to integrally form a driving threaded portion in the outer circumferential surface of one of a pair of first and second flanges 47 and 48 which are formed of an insulating material and attached to opposite-end opening portions of the aluminum drum 42.

Also in this example of a transfer drum assembly, the contact 44 and the metallic plate 43 are disposed inside of a rotating shaft 40, i.e., inside of the transfer drum 15.

Hence, it is apparent that the same advantages achieved by the first and second examples also can be obtained. In this example, the contact 44 is located generally at the center of the rotating shaft 40, and the durability of the sliding portion thereby is improved.

In the above-described embodiments, the present invention has been applied to an electrophotographic laser beam printer. However, the present invention can also be applied to other types of electrophotographic printers, image forming apparatus such as copying machines, and printers other than of the electrophotographic type. The construction, the shape and the material of the transfer drum and the charging contact may also be modified or changed according to various needs.

While the present invention has been described with respect to what presently are considered to be preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

an image carrier;

image forming means for forming a toner image on said image carrier; and a transfer member at a transfer position at which the toner image on said image carrier is transferred to the transfer member, said transfer member supporting member having a dielectric layer defining its outer surface and an elastic layer provided inside the dielectric layer, wherein said elastic layer has a compression range between about 0 to 2 mm at the transfer position, the total pressure of said compression is about 1 kg/mm in said compression range.

2. An image forming apparatus according to claim 1, wherein said elastic layer comprises an elastic foam material.

3. An image forming apparatus according to claim 2, wherein said elastic layer comprises a urethane foam.

4. An image forming apparatus according to claim 1, wherein the density of said elastic layer is in the range between about 20 to 150 $kg/m^3$.

5. An image forming apparatus according to claim 2, wherein the density of said elastic layer is in the range between about 20 to 150 $kg/m^3$.

6. An image forming apparatus according to claim 3, wherein the density of said elastic layer is in the range between about 20 to 150 $kg/m^3$.

7. An image forming apparatus according to claim 1, wherein said transfer member supporting member further comprises an electroconductive layer that is inside said dielectric layer, whereby electric power to said image forming apparatus is supplied through said electroconductive layer.

8. An image forming apparatus according to claim 7, wherein said electroconductive layer is provided between said dielectric layer and said elastic layer.

9. An image forming apparatus according to claim 7, wherein said electroconductive layer is provided inside said elastic layer as a support for said elastic layer.

10. An image forming apparatus according to claim 7, wherein said transfer member supporting member is rotatable and has a slide contact means for supplying electric power to said electroconductive layer, said slide contact means being disposed inside of said transfer member supporting member.

11. An image forming apparatus according to claim 10, wherein a member for supplying electric power to said electroconductive layer is disposed inside of a rotating shaft of said transfer member supporting member.

12. An image forming apparatus according to claim 1, wherein toner images in a plurality of colors are capable of being formed on said image carrier, and said toner images are successively transferred to the transfer member supported on said transfer member supporting member by being superposed.

13. An image forming apparatus according to claim 12, wherein the apparatus is capable of forming a full-color image on the transfer member.

* * * * *

UNITED STATES PATENT AND TRADEMARK OFFICE

CERTIFICATE OF CORRECTION

PATENT NO. : 5,250,994

DATED : October 5, 1993

INVENTOR(S) : AKIRA ITO, et al.

It is certified that error appears in the above-identified patent and that said Letters Patent is hereby corrected as shown below:

Title page:
At [57], line 1, "apparatus" should read --apparatus is--.

COLUMN 2
Line 27, "Q" should be deleted.

COLUMN 5
Line 45, "n" should read --in--.

COLUMN 6
Line 32, "portions 33" should read --portion 33--.
Line 39, "portions 33" should read --portion 33--.
Line 66, "b" should read --by--.

COLUMN 7
LINe 34, "trough" should read --through--.

COLUMN 9
Line 30, "member at" should read --member supporting member for supporting a transfer member at--.

Signed and Sealed this

Twenty-first Day of June, 1994

*Attest:*

BRUCE LEHMAN

*Attesting Officer*

*Commissioner of Patents and Trademarks*